US007351895B1

(12) United States Patent
LeBlanc

(10) Patent No.: US 7,351,895 B1
(45) Date of Patent: Apr. 1, 2008

(54) STRINGED MUSICAL INSTRUMENT BRIDGE AND ZERO FRET WITH EASILY ADJUSTABLE INTONATION MECHANICS FOR ACOUSTIC INSTRUMENTS

(75) Inventor: Curtis LeBlanc, Thibodaux, LA (US)

(73) Assignee: Curtis Robert LeBlanc, Thibodaux, LA (US)

( * ) Notice: Subject to any disclaimer, the term of this patent is extended or adjusted under 35 U.S.C. 154(b) by 478 days.

(21) Appl. No.: 10/841,155

(22) Filed: May 7, 2004

(51) Int. Cl.
*G10D 3/04* (2006.01)

(52) U.S. Cl. ..... 84/298

(58) Field of Classification Search ..... 84/298, 84/312 R, 314 N, 314 R, 290
See application file for complete search history.

(56) References Cited

U.S. PATENT DOCUMENTS

| | | | | |
|---|---|---|---|---|
| 615,053 | A | 11/1898 | Lincoln | |
| 934,678 | A | 9/1909 | Laurian | |
| 2,491,788 | A | 12/1949 | Widowson | |
| 4,208,941 | A | 6/1980 | Wechter | |
| 4,464,970 | A | 8/1984 | Mischakoff | |
| 4,768,414 | A | 9/1988 | Wheelwright | |
| 5,208,410 | A | 5/1993 | Foley | |
| 5,265,512 | A * | 11/1993 | Kubicki et al. | 84/298 |
| 5,600,078 | A | 2/1997 | Edwards | |
| 5,602,353 | A * | 2/1997 | Juszkiewicz et al. | 84/298 |
| 5,750,910 | A * | 5/1998 | LoJacono | 84/314 N |
| 5,834,665 | A | 11/1998 | Hanns et al. | |
| 6,124,536 | A | 9/2000 | Hoshino | |
| 6,166,309 | A * | 12/2000 | Hoshino | 84/298 |
| 6,184,450 | B1 * | 2/2001 | LeBlanc | 84/307 |
| 6,359,202 | B1 | 3/2002 | Feiten et al. | |
| 6,433,264 | B1 | 8/2002 | Gimpel et al. | |
| 6,456,722 | B1 | 9/2002 | Davey et al. | |
| 6,706,957 | B1 * | 3/2004 | Merkel | 84/314 N |
| 6,818,814 | B2 * | 11/2004 | Park | 84/298 |
| 2002/0092404 | A1 | 7/2002 | Naimish | |
| 2004/0040432 | A1 | 3/2004 | Erickson et al. | |

* cited by examiner

*Primary Examiner*—Briggitte R. Hammond

(57) ABSTRACT

An improved stringed instrument bridge and zero fret with easily adjustable intonation mechanics for stringed instrument with a plural of saddle bodies, a wire holder tightly affixed to the saddle body securing the saddle bodies in place, the saddle body is adjusted by moving the wire holder affixed to the saddle body, a top plate body with a plural cut outs, securing the saddle bodies in place, an anchor body, with a plural of long thin screws passing through apertures in existing guitar bridge body, and into threaded apertures in the anchor body pulling everything together tightly, and providing a means for adjusting the instruments tone and amplitude, therefore this invention provides an improved instrument bridge with easily adjustable intonation that does not lose its position while changing strings or playing the instrument.

5 Claims, 6 Drawing Sheets

Prior Art

STRINGED MUSICAL INSTRUMENT BRIDGE AND ZERO FRET WITH EASILY ADJUSTABLE INTONATION MECHANICS FOR ACOUSTIC INSTRUMENTS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates to a bridge and a zero fret for string instruments particularly a bridge and a zero fret providing means for adjustment of string intonation and comfort, while staying affixed to the guitar until the decision of removal without any alterations to the instrument and also improving the instruments sound producing characteristics.

STATE OF THE ART

Guitar tuning is based on the equal-tempered scale in which the ratio of each successive semitone to the next is based to the twelfth root of two. The twelfth root of two equals 1.0594631 and it is this ratio of 1.0594631:1 which is used as the basis for computing semitone intervals in equal tempered tuning. "The rule of eighteen" simply states that the successive ration 17:18 indicates that if a selected string length is divided into eighteen parts the distance from the saddle of the bridge to the first fret will equal seventeen parts. Progressively this is generally how intonation is achieved on the equal tempered scale. (Refer to Physics For Scientist & Engineers, 2nd Edition, Chapters 18.1 through 18.4).

With that being said, the problems with the ongoing life of a stringed musical instrument is that it has many different variables involved with the intonation that changes through time. Such as string sizes, string materials (what the string is made of), elasticity factors, and normal wear and tear on an instrument such as the curve on the neck over time from constant string tension.

Many professional and novice guitar players prefer that their instrument is correctly intonated so that their guitars play equally intone at all points on the fingerboard, and more and more professionally produced shows and recording studios demand proper intonation, but proper intonation of each of the strings is difficult on aftermarket guitars, since there string lengths are determined by the location of one nonadjustable bridge insert installed on the instrument at the time of its manufacture. On most guitars on the market today there is very little room to supply a mechanical means to adjust intonation and adding heavy mechanics to an acoustic instruments soundboard and bridge destroys the sound generating characteristics of the instrument.

In general most guitars come manufactured with a groove cut in the bridge body for insertion of a guitar bridge blank.

This bridge blank is what is used to adjust the height and intonation of that guitar. By removing material from the bottom of the bridge blank you can adjust the height. By removing material from the front or back of the top corner along the length of the bridge blank you can adjust the intonation. The problem with this method is that your are limited with your intonation adjustment by the width of the groove in the bridge body usually only ⅛ of an inch wide. This method is also costly and time consuming each time it is done. Attempts to correct these problems have been made for many years. The disadvantages of U.S. Pat. No. 4,464,970; U.S. Pat. No. 4,768,414; and U.S. Pat. No. 5,602,353 is that the adjustable saddle unit under the strings can fall out and be lost when changing the strings, cleaning the guitar, or even while playing the guitar (if strings pop). Furthermore some of these patents did not provide the continuous string length adjustment required for precise intonation.

In U.S. Pat. No. 615,053; U.S. Pat. No. 934,678; U.S. Pat. No. 2,491,788; U.S. Pat. No. 4,208,941; U.S. Pat. No. 5,834,665; U.S. Pat. No. 6,166,309; U.S. Pat. No. 6,359,202; and application No. 20020092404 all these bridges had to be installed at the time of manufacture or else undesirable modifications and possible damage would have to be done to the guitar. Users found these types of bridges unsatisfactory.

Users found that the heavy mechanics of these bridges used in U.S. Pat. No. 5,600,078; U.S. Pat. No. 6,124,536; U.S. Pat. No. 6,456,722; and application No. 20040040432 subdued the vibration of the top of the instrument and it diminished the guitars volume and tone. Also most of the parts used in these bridges are more prone to mechanical failure and breakage. All of these disclosed devices are unnecessarily complex and expensive. Also using these types of bridges caused irreversible modifications to the guitar, in turn causing the resale value of the instrument to be greatly lowered. Many guitarists found this type of bridge unusable and not as ascetically pleasing on there guitars.

U.S. Pat. No. 5,208,410 needs a minimum height of exposed saddle to work properly. This patents design does not allow the strings to be adjusted as close to the fingerboard as possible, therefore on some guitars this design makes the strings clearance off the fret board too high and unfavorable.

U.S. Pat. No. 6,433,264 is costly and time consuming to install. It must be installed, removed, adjusted by removing material from the front side of the zero fret member, and then reinstalled repeatedly until intonation is correct on that instrument. Once installed on the instrument the only way to adjust it again is to subtract more material from the zero fret member or replace it all together. This is a destructive alteration since you are removing material from the zero fret member that can not be replaced unless you replace the whole zero fret member.

U.S. Pat. No. 5,750,910 has more mechanics than needed which produces more room for mechanical failure such as screws stripping due to the force of the strings pushing down on each zero fret member. Furthermore this device is unnecessarily complex and expensive to manufacture, and it is prone to inaccuracies after repeated use over time.

BRIEF SUMMARY OF THE INVENTION

The primary object of the invention is to provide a stringed musical instrument bridge and zero fret with easily adjustable intonation mechanics that is easy to install without any alteration to the instrument.

A further object of the invention is to provide a stringed musical instrument bridge and zero fret with easily adjustable intonation mechanics that can be safely removed from the instrument without any damage, so that the instrument is left in original condition.

Another object of the invention is to provide a means for intonating a stringed musical instrument that can be applied either at the zero fret or bridge or a combination of both.

Another object of the invention is to provide a stringed musical instrument bridge and zero fret that is easy to operate and intonate the musical instrument.

A further object of the invention is to provide a stringed musical instrument bridge and zero fret that has less mechanical parts so it would be less prone to mechanical failure.

Still yet another object of the invention is to provide a stringed instrument bridge and zero fret that is easier and cheaper to manufacture, yet more reliable.

Another object of the invention is to provide a stringed musical instrument bridge and zero fret that will stay where it was previously set even while changing the strings and cleaning the instrument.

Another object of the invention is to provide a stringed musical instrument bridge and zero fret that is ascetically pleasing as to match any instrument it may be applied on.

Still yet another object of the invention is to provide a stringed musical instrument bridge and zero fret that the string height can be adjusted to minute amounts above the fret board regardless of existing bridge body.

Yet another object of the invention is to provide a stringed musical instrument bridge and zero fret that allows access to the contact point of each individual bridge for muting and general purposes of technique and method.

Yet another object of the invention is to provide a stringed musical instrument bridge and zero fret that allows a solid vibration chain from the guitar string to the soundboard.

Still yet another object of the invention is to provide a stringed musical instrument bridge that generates sound amplification improving the volume and tone of the stringed musical instrument.

And yet another object of the invention is to provide a stringed musical instrument zero fret that adds mass to the head stock making it heavier so more of the vibration or sound generating force is transferred to the guitar bridge and sound board giving the instrument improved tone and more sustain.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an improved stringed instrument bridge and zero fret with easily adjustable intonation mechanics for acoustic stringed instruments comprising: a instrument bridge saddle blank in existing bridge saddle groove positioned transversely to and below the plural of strings, said bridge saddle blank being evenly flushed with an existing guitar bridge body, a plural of saddle bodies with a wire holder tightly affixed to said saddle body providing means for securing the saddle bodies in place, said saddle body is adjusted along a parallel axis to the string by means of moving said wire holder affixed to the saddle body, a top plate body with a plural of 90 degree or dove tail cut outs along a parallel axis to the string, also providing means for securing said saddle bodies in place along a perpendicular axis of the string, said top plate body also comprising a plural of apertures through top plate body so as to line up with apertures in said existing instrument bridge body, an anchor body with a lower string guide cut out in said anchor body to provide easy means for string installation through aperture in said anchor body, to also provide a means for acoustic amplification by transferring energy from the string to acoustic optimizers, and a upper string guide structure affixed to said anchor body to provide a means to make the guitar string turn towards the saddle body while passing through existing apertures in said guitar bridge body and said plural of cut outs in said top plate body, and a plural of knurled screw heads and long thin screws passing through the saddle body wire holders, said apertures in top plate body, said apertures in existing instrument bridge body, and into threaded apertures in said anchor body providing a means to pull everything together securing the plural of saddle bodies at the said wire holders.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

In reference to disclosure document No. 513916; granted on Jun. 19, 2002 the detailed descriptions of the preferred embodiment are provided herein. It is to be understood; however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

Figure 1A:
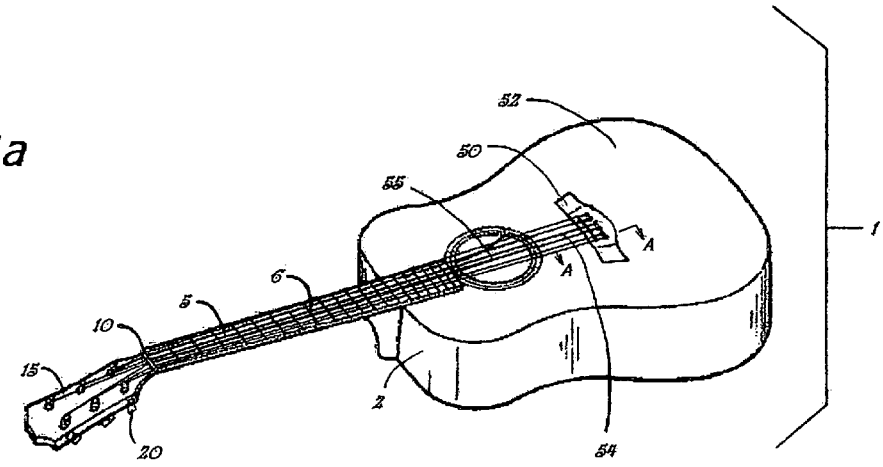
FIG. 1*a* is a perspective view of a conventional acoustic guitar embodiment showing prior art.

Turning first to FIG. 1*a* there is shown the basic configuration of a conventional acoustic guitar 1 having sides 2, having a sound board 52 on which existing bridge body 50 is mounted. Guitar strings 54 which stretch over aperture 55 in guitar sound board 52 for acoustic amplification, over the fret board 7, frets 6, and across the original zero fret 10 to the tuning mechanics 20 secured on guitar head stock 15 showing prior art.

Figure 1B:
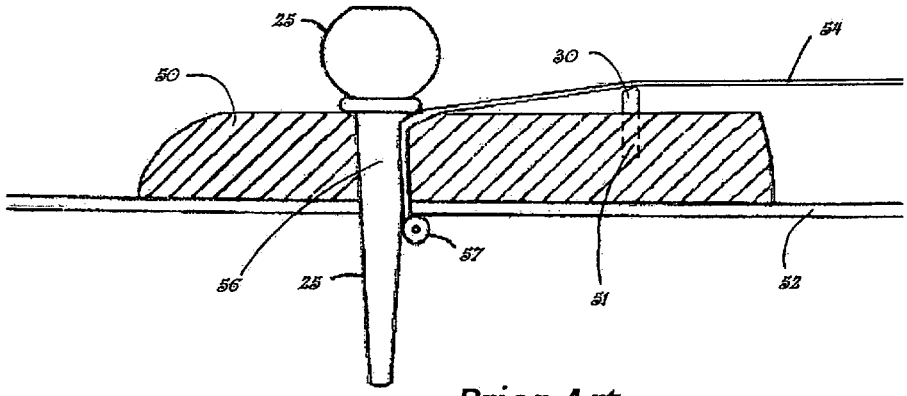
Prior Art Fig. 1b
FIG. 1*b* is a cross sectional view of a conventional guitar bridge pin construction showing prior art.

Turning to FIG. 1*b* it shows a cross-sectional view {A} of conventional means for retaining a guitar string stop 57 comprising of said existing bridge body 50 on the guitar 1 the sound board 52 and a bridge pin 25 which wedges the string stop 57 against the sound board 52 through an aperture 56 in the existing bridge body 50. Also describing existing bridge groove 51 and how the original bridge blank 30 counter sinks into existing bridge body 50 further showing that the only means of intonating the instrument at that time is confined to the width of the existing bridge groove 51.

Therefore, the best mode for carrying out the invention is presented in terms of its preferred embodiment, herein depicted within the FIGS. 2 and 3.

Figure 2A:
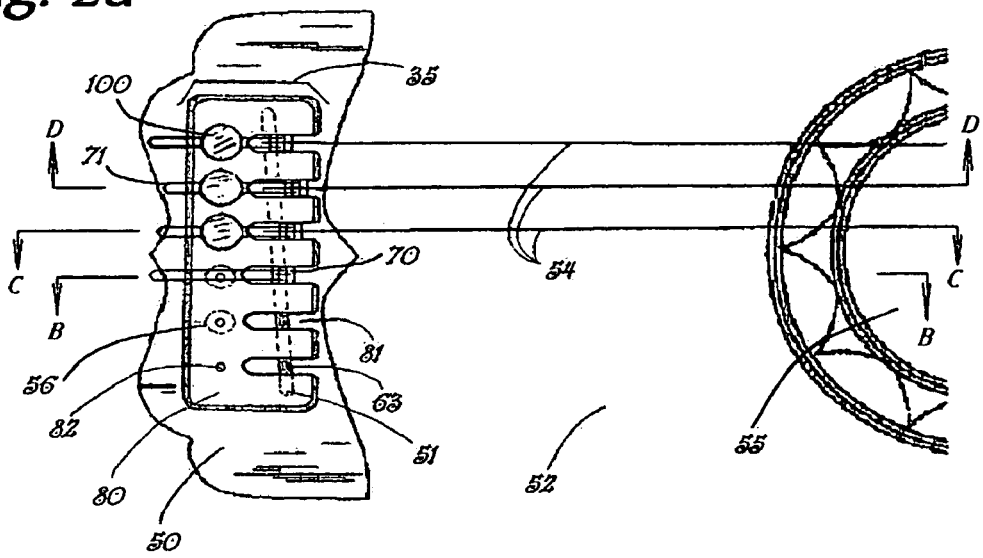
FIG. 2*a* is a plan view of preferred embodiment partially assembled on the guitar.

In accordance with the present invention, FIG. 2*a* refers to a top view of the preferred embodiment of an improved stringed musical instrument bridge with easily adjustable intonation mechanics 35 in position on an acoustic guitar 1. It describes the preferred embodiment installed on an acoustic instrument such as a guitar, comprising of a top plate body 80, with a plural of 90 degree or dove tail cut outs 81 open on one end along a parallel axis to the string 54, providing means for securing a plural of saddle bodies 70 in place along a perpendicular axis of the string 54, allowing insertion of said saddle bodies 70 positioned transversely to and below the plural of strings 54, the saddle body 70 is also the last contact point at the bridge 50 for the strings 54. And also showing existing bridge groove 51 on existing bridge body 50, and bridge blank 63 being evenly flushed with the existing guitar bridge body 50, positioned transversely to and below the plural of strings.

Figure 2B:
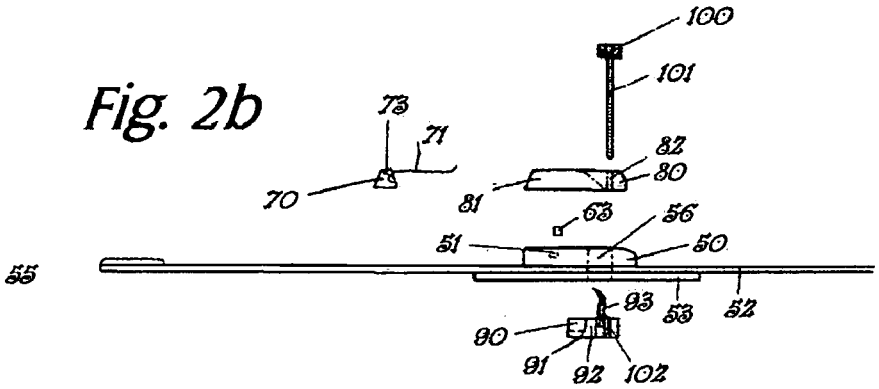
FIG. 2*b* is an exploded side view of preferred embodiment of the invention.

Upon inspection of, FIG. 2*b* the exploded side view {B} of the preferred embodiment of the invention will be seen, it also shows the top plate body 80 comprising a plural of apertures 82 through top plate body 80 so as to line up with apertures 56 in existing guitar bridge body 50. Further describing in detail the existing bridge groove 51 on existing guitar bridge body 50 previously cut at the time of manufacture in said bridge body 50 of the guitar 1 attached to sound board 52 on guitar 1 and having an under plate 53 which is attached to the inside of the sound board 52 of the guitar 1. FIG. 2*b* also shows a bridge blank 63, cut to be flush with existing bridge body 50 when installed on guitar 1, so that when a saddle body 70 is placed on existing bridge body 50 it creates a solid vibration chain from the saddle body 70 to the soundboard 52 without obstructed adjustment of intonation. Furthermore the saddle body 70 has a cut out 73 in the saddle body 70 for height adjustment by means of removing material from the top of saddle body 70 with a saw or file, and a wire holder 71, or ridged sheet material tightly affixed to saddle body 70 to help hold the saddle body 70 in place along a parallel axis of the string 54. Also providing a means to adjust said saddle body 70 along a parallel axis to the string 54. The wire holder 71 holds the saddle body 70 in place by means of being clamped between a knurled screw head 100 and said top plate body 80. FIG. 2*b* also shows a cross-sectional view of an anchor body 90 with a lower string guide cut out 91 in anchor body 90 to guide easy string 54 installation into aperture 92 through anchor body 90, upper string guide 93 to make guitar string 54 turn towards the saddle body 70 and to further guide string 54 installation through aperture 56 in existing guitar bridge body 50, and threaded aperture 102 through anchor body 90 for long thin screw 101 to screw into and pull everything together.

Figure 2C:
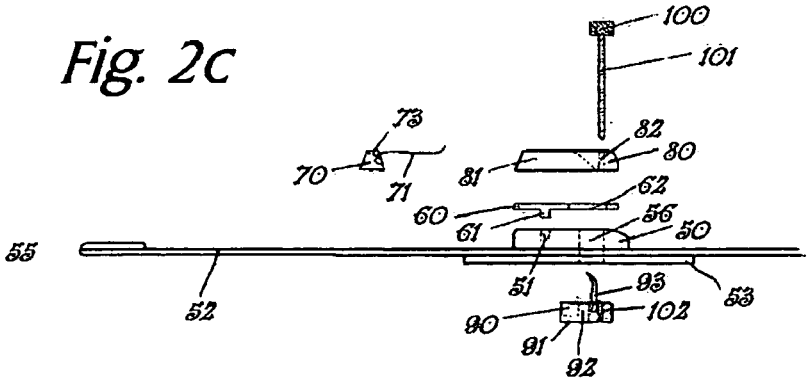
FIG. 2*c* is an exploded side view of preferred embodiment with a base plate replacing the bridge blank for height adjustment.

In accordance with the present invention, FIG. 2*c* describes the exploded side view {B} of the preferred embodiment of the invention, further describing the top plate body 80 also comprising a plural of apertures 82 through top plate body 80 so as to line up with apertures 56 in existing guitar bridge body 50. Furthermore it describes in detail existing bridge groove on body of guitar 51 previously cut at the time of manufacture in existing bridge body 50 of the guitar 1. FIG. 2*c* further shows base plate 60 added instead of bridge blank 63 (as shown in FIG. 2*b*), for additional height of strings, with T-leg 61 to counter sink into existing bridge groove 51 on existing bridge body 50 and aperture 62 allowing assembly of other components, so that when a saddle body 70 is placed on existing bridge body 50 it creates a solid vibration chain from the saddle body 70 to said soundboard 52 without obstructed adjustment of intonation.

Figure 3A:
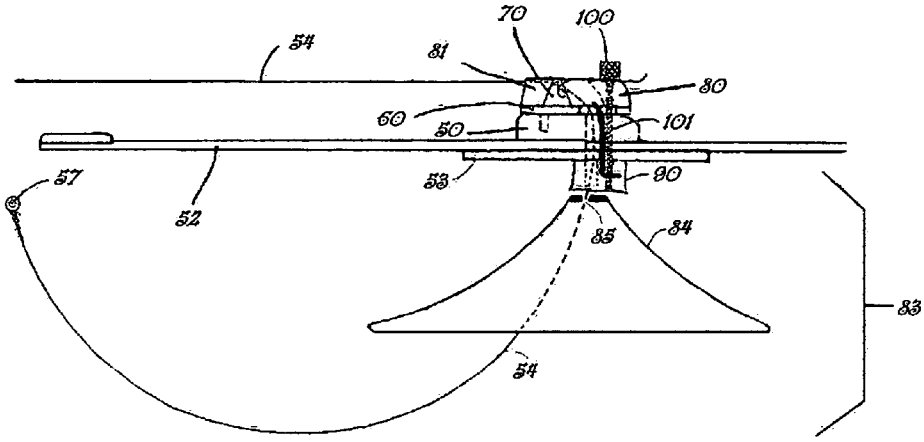
FIG. 3*a* is a fully assembled cross sectional view of preferred embodiment of the invention with string passing through it further showing an acoustic optimizer installed.

In accordance with an important feature of the present invention, there is shown in FIG. 3*a* a means to amplify and tune the sound cavity 26 of an acoustic instrument. FIG. 3*a* describes a side view {C} of the preferred embodiment of the invention fully assembled further showing how the guitar string 54 with guitar string stop 57 installs through an acoustic optimizer 83. It is to be noted that as the string 54 passes through a plural of apertures 84 in an elongated cone 85 it pulls against the anchor body 90 providing a means for transferring energy from the string 54 and bridge 50 to the elongated cone 85. The plural of apertures 84 placed transversely to and bellow the strings 54 in the elongated cone 85 allow each string 54 to pull on a different position of the elongated cone 85 securing said elongated cone 85 tightly to the anchor body 90.

Figure 3B:
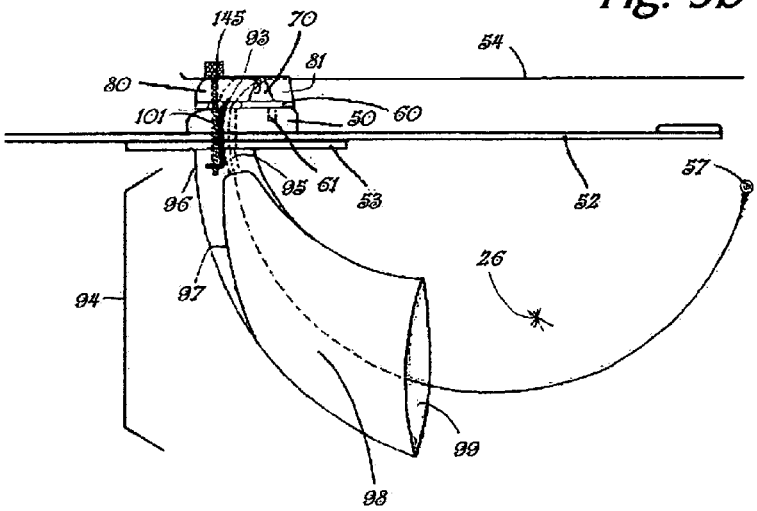
FIG. 3*b* is a fully assembled cross sectional view of preferred embodiment of the invention with string passing through it further showing an alternate acoustic optimizer installed.
Figure 6B:
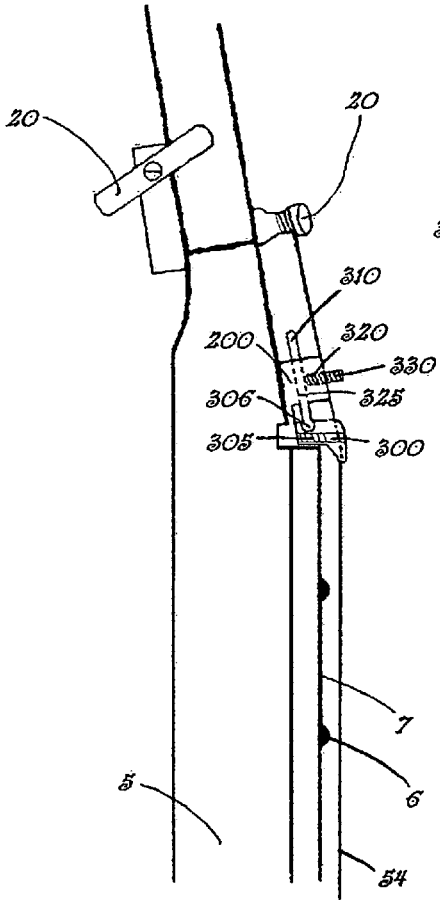
FIG. 6*b* is a cross-sectional side view thereof.

In accordance with another important feature of the present invention, there is shown in FIG. 3*b* a means to amplify and tune the sound cavity 26 of an acoustic instrument. FIG. 6*b* shows a side view {D} of the preferred embodiment of the invention fully assembled showing how the guitar string 54 with guitar string stop 57 installs through a aperture 95 in an alternate acoustic optimizer 94 which provides a means to convert energy from the string 54 and bridge 50 into acoustic sound waves by further means of the string stop 57 vibrating a tone resonator 97 being amplified in a amplification chamber 98. The sound waves leave the amplification chamber 98 through a opening 99 in the amplification chamber 98 into a sound cavity 26 in the guitar 1 further amplifying the sound waves. It is envisioned that the acoustic optimizer 83 and the alternate acoustic optimizer 94 can be made of sound resonating material and can be made geometrically differently, depending on which string 54 it is installed on further improving the instruments tone and amplitude.

Other modes for carrying out the invention may be done in various ways without departing from my invention, and is presented in terms of alternate embodiments, herein depicted within FIGS. 4 through 7.

Figure 4:
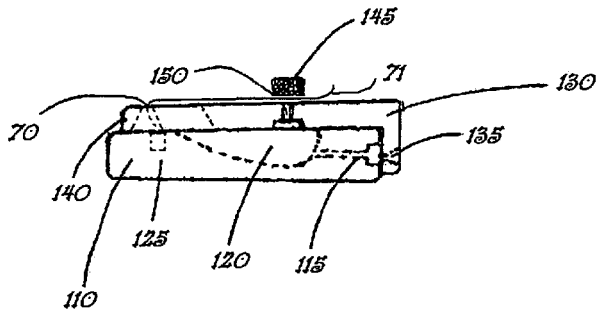
FIG. 4 is a cross sectional side view of an alternate embodiment of the invention.
Figure 5:
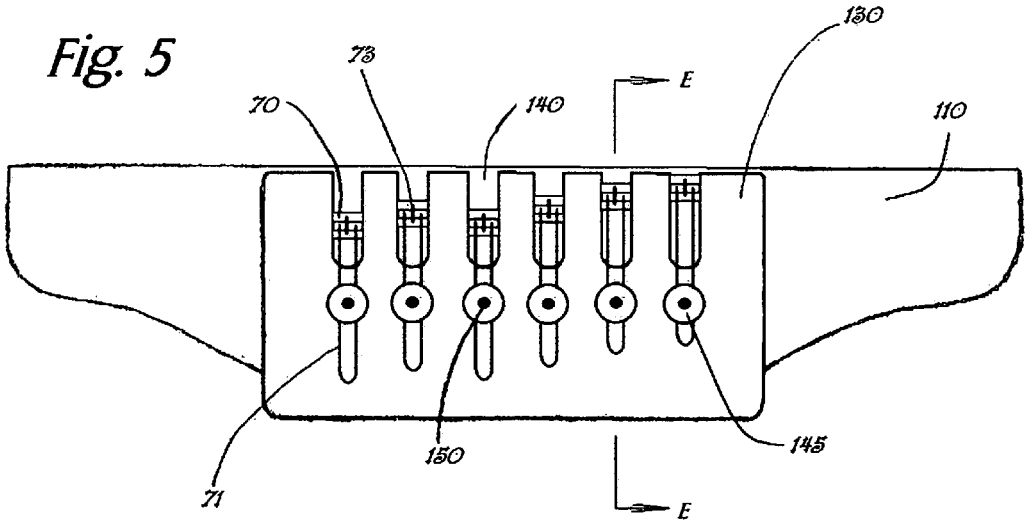
FIG. 5 is a plan view of the alternate embodiment of the invention.

Turning now to FIG. 4 it describes a side view {E} of an alternate embodiment of the invention, further describing an alternate top plate body 130 which has a plural of apertures 135 for the strings 54 to go though and a plural of dovetail cutouts 140 to hold the saddle body 70 in place in a perpendicular axis to the strings 54. A plural of threaded screws 150 tightly affixed to the alternate top plate body 130 for a plural of knurled nuts 145 to screw onto and provide a means for clamping wire holders 71 to keep saddle body 70 from moving in a parallel axis to the string 54 also describing existing alternate bridge body 110, aperture 115 in existing alternate bridge body 110, tear drop cutout 120 in existing alternate bridge body 110, and existing groove 125 on existing alternate bridge body 110 which bridge blank 63 will counter sink into being flush with existing alternate bridge body 110 to hold saddle body 70 and provide a solid vibration chain from the string 54 to the soundboard 52.

In accordance with the present invention, FIG. 6 describes a top view of an alternate embodiment of the invention showing existing alternate bridge body 110 with alternate top plate body 130 installed, a plural of knurled nuts 145 and a plural of threaded screws 150 providing a means for clamping wire holders 71 which holds the saddle body 70 in place on a parallel axis to the string 54. Also showing a plural of dovetail cutouts 140 in alternate top plate body 130 which holds the saddle body 70 in place on a perpendicular axis to the strings 54.

Figure 6A:
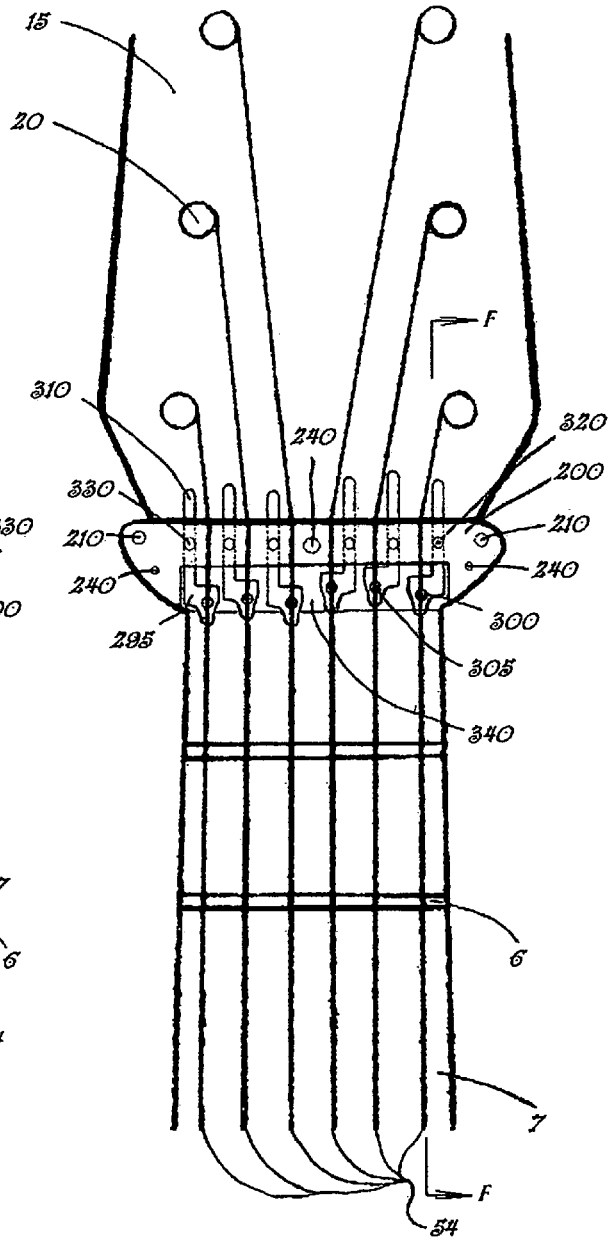
FIG. 6*a* is a plan view of yet another alternate embodiment of the present invention designed for the head stock in position on the guitar.

Further in accordance with the invention FIG. 6*a* describes a top view of an alternate embodiment designed to be applied at the zero fret 10 partly installed on the instrument. This embodiment shows a plural of adjustable zero frets 295 which rest on the cutout 340 in the bottom plate housing 200 and protrudes over the fret board 7 to change the original length of the string 54 for a shorter or longer distance from the guitar bridge 50. Each adjustable zero fret 295 has a aperture 300 with a screw 305 to adjust the exact height of that adjustable zero fret 295 according to the fret board 7 and frets 6 so as to allow for a more comfortable playing environment as the instrument ages. FIG. 6*a* further shows a plural of cylindrical adjustment rods 310 attached to the adjustable zero frets 295 so as to allow rotation for the height adjustment. The adjustment rods 310 run through a plural of apertures 325 along a parallel axis to the strings 54 to provide means for adjusting the position of the adjustable zero frets 295. Further showing a plural of apertures 320 with threaded screws 330 placed perpendicular to the strings axis in the bottom plate housing 200 to provide a clamping means for the adjustment rod 310. The bottom plate housing 200 also comprising two apertures 210 located on opposite sides of the strings 54 to provide a means to secure this alternate embodiment to the guitar neck 5 further shown in FIG. 7*b*. And three more threaded apertures 240 to provide a means to secure the cover plate 250 further shown in FIG. 7*a*.

In further accordance with the invention, FIG. 6*b* describes a side, cross sectional view of said bottom plate housing 200 described in FIG. 6*a* further showing how the adjustable zero fret 295 protrudes over the fret board 7 to change the original length of the string 54 for a shorter or longer distance from the guitar bridge 50. Also showing said aperture 300 with said screw 305 to adjust the exact height of that adjustable zero fret 295 according to the fret board 7 and frets 6. A pivot point 306 to allow rotation of the adjustable zero fret 295 by means of the height adjustment screw 305, a side, cross sectional view of said aperture 325 for the cylindrical adjustment rod 310 to go through and a aperture 320 with threaded screw 330 placed perpendicular to the strings axis in the bottom plate housing 200 to provide a clamping means for the adjustment rod 310.

Figure 7B:
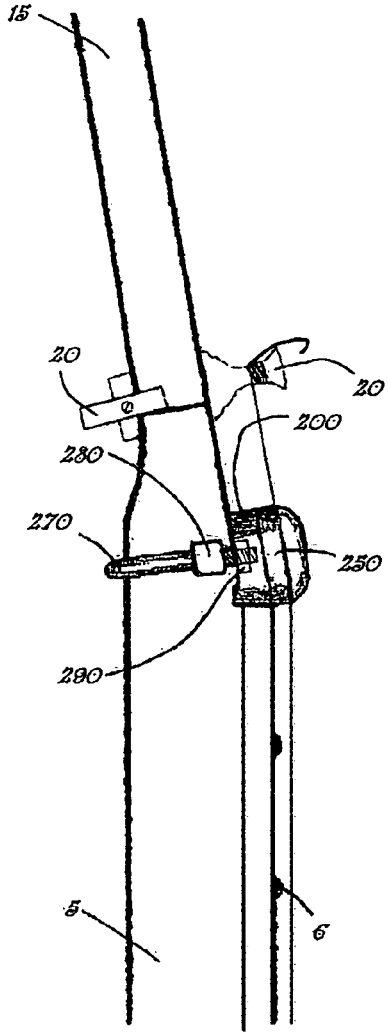
FIG. 7*b* is a side view thereof.
Figure 7A:
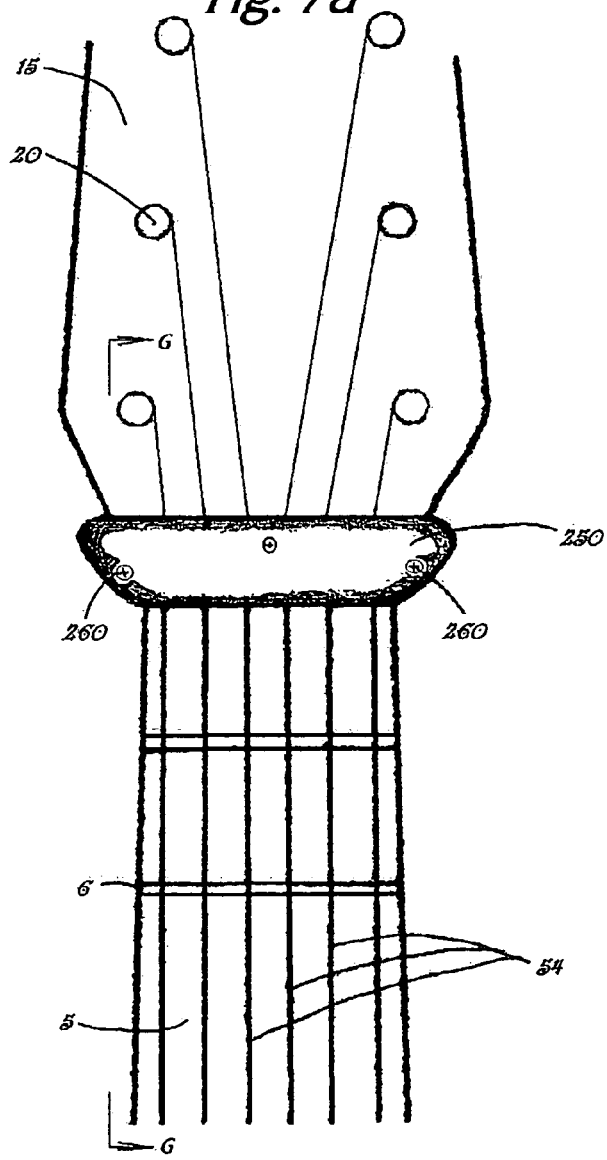
FIG. 7*a* is a plan view of fully assembled embodiment of the present invention designed for the head stock in position on the guitar.

In accordance with the present invention, FIG. 7*a* shows a fully assembled top view of the alternate embodiment mentioned in FIG. 6*a* illustrating a cover plate 250 which is held on by means of threaded screws 260 that screw into said threaded apertures 240 in the bottom plate housing 200.

In accordance with the present invention, FIG. 7*b* relates to a fully assembled side view of the alternate embodiment mentioned in FIG. 6*a* illustrating a cable 270 tightly affixed to threaded bolt 280 going through apertures 210 located on opposite sides of the strings 54 in the plate housing 200 going around the guitar neck 5 to provide a means to secure this embodiment to the instrument 1, a threaded nut 290 shown in cut away view {G} screwed on to the threaded bolt 280 to provide a means for tightening the cable 270 around the guitar neck 5. This embodiment also adds mass to the head stock making it heavier so more of the vibration or sound generating force is transferred to the guitar bridge 50 and sound board 52 giving the instrument improved tone and more sustain.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An improved stringed musical instrument bridge with easily adjustable intonation mechanics for acoustic instruments comprising a guitar bridge saddle blank resting in an existing bridge saddle groove, said existing bridge saddle groove disposed in an existing guitar bridge body having a plurality of apertures, said guitar bridge saddle blank being held in place by said existing bridge saddle groove positioned transversely to and below a plurality of strings, said bridge saddle blank being evenly flushed with an existing guitar bridge body.

2. The improved stringed musical instrument bridge of claim 1, further comprising a plurality of saddle bodies slidably positioned on said existing guitar bridge body, said plurality of saddle bodies each having a rigid wire holder tightly affixed to each of said saddle bodies for slidably securing each of said saddle bodies in place along an axis parallel to a plurality of guitar strings.

3. The improved stringed musical instrument bridge of claim 2, further comprising a top late body positioned on top of said existing guitar bridge body, said top plate body comprising:

(a) a plurality of dove tail cut outs for preventing movement of said plurality of saddle bodies in perpendicular relationship to said axis parallel to said plurality of guitar strings; and (b) a plurality of apertures through said top plate body so as to line up with said apertures in said existing guitar bridge body.

4. The improved stringed musical instrument bridge of claim 3, further comprising a plurality of anchor bodies positioned underneath an existing sound board and aligned with said apertures in said existing guitar bridge body, said plurality of anchor bodies each comprising:

(a) a plurality of lower string guides, where each of said lower string guides is cut out for installing one of said plurality of guitar strings through one of said apertures in one of said plurality of anchor bodies;

(b) a plurality of upper string guides, where each of said upper string guides is affixed to one of said anchor bodies for guiding the guitar string towards the saddle body while passing through one of said existing apertures in said guitar bridge body and one of said plurality of cut outs in said top plate body; and (c) a threaded hole adjacent to each of said string guide cut outs.

5. The improved stringed musical instrument bridge of claim 4, further comprising a plurality of knurl-headed screws passing through said wire holders of said saddle bodies, said apertures in top plate, said apertures in existing guitar bridge body, and into threaded apertures in said anchor body, thereby providing a means to pull everything together securing the plurality of saddle bodies at said rigid wire holders.

* * * * *